US005780759A

United States Patent [19]

Szalay

[11] Patent Number: 5,780,759

[45] Date of Patent: Jul. 14, 1998

[54] METHOD FOR PITCH RECOGNITION, IN PARTICULAR FOR MUSICAL INSTRUMENTS WHICH ARE EXCITED BY PLUCKING OR STRIKING

[75] Inventor: Andreas Szalay, Emmelshausen, Germany

[73] Assignees: Blue Chip Music GmbH, Germany; Yamaha Corporation, Japan

[21] Appl. No.: 574,590

[22] Filed: Dec. 19, 1995

[30] Foreign Application Priority Data

Jan. 12, 1995 [DE] Germany ..... 195 00 750.6

[51] Int. Cl.[6] ..... G10G 7/02

[52] U.S. Cl. ..... 84/454; 84/455; 84/616; 84/654; 84/DIG. 18

[58] Field of Search ..... 84/454, 455, DIG. 18, 84/615–616, 653–654

[56] References Cited

U.S. PATENT DOCUMENTS

| | | | |
|---|---|---|---|
| 4,688,464 | 8/1987 | Gibson et al. | 84/454 |
| 4,817,484 | 4/1989 | Iba . | |
| 4,841,827 | 6/1989 | Uchiyama | 84/1.01 |
| 4,882,965 | 11/1989 | McClish . | |
| 4,924,746 | 5/1990 | Obata . | |
| 5,001,960 | 3/1991 | Katou | 84/735 |
| 5,014,589 | 5/1991 | Obata | 84/735 |
| 5,349,130 | 9/1994 | Iwaooji . | |

*Primary Examiner*—William M. Shoop, Jr.
*Assistant Examiner*—Marlon T. Fletcher
*Attorney, Agent, or Firm*—Graham & James LLP

[57] ABSTRACT

A method is specified for pitch recognition, in particular for musical instruments which are excited by plucking or striking, in the case of which method the interval between zero crossings of a signal waveform of an audio signal is used as a measure for the period length of the audio signal.

Reliable pitch recognition is intended to be possible in a simple manner using such a method. The method is intended to be capable of being implemented with a low level of computation power.

To this end, the magnitude of the gradient of the signal waveform is in each case determined in the region of its zero crossings, and the magnitude of the gradient is used as an assessment criterion for the selection of the zero crossings to be evaluated.

17 Claims, 4 Drawing Sheets

METHOD FOR PITCH RECOGNITION, IN PARTICULAR FOR MUSICAL INSTRUMENTS WHICH ARE EXCITED BY PLUCKING OR STRIKING

BACKGROUND OF THE INVENTION

1. Field of the Invention

The invention relates to a method for pitch recognition, in particular for musical instruments which are excited by plucking or striking, in the case of which method the interval between zero crossings of a signal waveform of an audio signal is used as a measure for the period length for the audio signal.

Although, in the time period when synthetic audio or tone production started, reference was made to keyboard musical instruments in which each key was assigned a clearly defined tone, efforts have for some time also been directed at using other musical instruments for synthetic tone or sound production. An exemplary application of this is a guitar, in which a tensioned string is caused to oscillate by plucking or striking, either directly using the fingers or using a plectrum. Different pitches can be produced, as is known, in the case of a guitar by varying the effective oscillation length of the string. Although the oscillation of the string in the case of a classic, acoustic guitar was made directly audible by the resonance of the guitar body, in the case of synthetic tone production it is necessary to determine the oscillation frequency of the excited string. Once the pitch has been determined, a corresponding signal can be produced and further processed. The problem arises not only in the case of guitars, but also in the case of other string instruments which are plucked or struck, for example a harp, bass, zither or the like. Pitch recognition may occasionally be of interest even in the case of drums. In principle, such methods can, however, also be used for all other audio signals, for example the human voice, which can be further processed in a so-called "voice follower". However, for simplicity, the following description is provided on the basis of pitch recognition in the case of a guitar.

2. Description of Related Art

U.S. Pat. No. 5,014,589 describes such a method for pitch recognition, in which the zero crossings of the audio signal are determined. The interval between two zero crossings in the same direction is considered as a measure for the period length. The inverse value of the period length corresponds to the frequency. The problem in such pitch recognition is that, in addition to the zero crossings which determine the period length, zero crossings of the audio signal which are caused, for example, by harmonics can also occur within one period. In the case of the known method, it is therefore necessary to determine not only the points in time of the zero crossings but also the amplitude maxima of the signal waveform. A type of envelope curve is produced in this case, which is also called an "envelope follower". In consequence, additional criteria are obtained in order to assess whether a zero crossing does or does not represent the boundary of a period. A pitch signal is produced when two successive period lengths do not differ by more than a specific amount.

The signal processing in such methods is increasingly carried out digitally. In the case of the known method, considerable computation power is necessary. If one keeps sight of the fact that this computation power must be kept available not only for one string but for a plurality of strings, it quickly becomes clear that an economical solution cannot be practically implemented with the processors available at the moment.

SUMMARY OF THE INVENTION

The invention is thus based on the object of achieving reliable pitch recognition in a simple manner.

This object is achieved in the case of a method of the type mentioned initially by the magnitude of the gradient of the signal waveform in each case being determined in the region of its zero crossing, and by the magnitude of the gradient being used as an assessment criterion for the selection of the zero crossings to be evaluated.

The required computation power can be drastically reduced, to be precise to less than a tenth as a rule, compared to the method which is known from U.S. Pat. No. 5,014,589. Specifically, the audio signal, which is present in digitalized form from samples, need be evaluated only in the region of its zero crossings. The zero crossings can easily be determined by comparison of the polarity of two successive samples. All the other samples can be left out of the evaluation. A few values in the region of the zero crossings can be considered in addition, if required, in order to improve the accuracy. The gradient of the zero crossings can likewise be determined relatively easily. If one presupposes a constant sampling frequency, it is in principle sufficient to determine the interval between the two samples before and after the zero crossing. It is now possible to define that the signal waveform of the audio signal is at its steepest at the zero crossings which bound one period. Therefore, all that need be considered is the steepest zero crossings of the same polarity. The interval between these zero crossings is then the period length. The information which is necessary to assess the question as to whether a zero crossing is or is not significant for the period length is thus obtained directly from the signal waveform at the zero crossing. It is thus possible to reduce the necessary computation power very considerably because only those samples which are located at the zero crossing or in its immediate vicinity need be included at all in the calculation. The use of the zero crossings in which the signal waveform is at its steepest, that is to say has the greatest gradient, furthermore has the advantage that the influences of disturbances are at their lowest here. If, in the simplest case, such a disturbance is regarded as an offset (shift in the signal waveform by a constant value in the positive or negative direction), a shift in the point at which the signal waveform crosses the zero axis in the case of a zero crossing with a flat signal waveform results which is larger than if a zero crossing with a steep signal waveform were considered. The accuracy of pitch recognition is thus improved by the limitation to such zero crossings.

Since the information about the audio signal waveform is no longer required, apart from a relatively narrow band around the zero crossings, it is also possible to manage with relative coarse resolution, that is to say a low sampling rate. The human ear has relatively fine resolution in its own frequency bands. The pitch information should thus be achieved with an accuracy of approximately 1 cent, that is to say 1/100th of a half-tone. In the case of a guitar, whose frequency range extends from about 80 Hz to 1 kHz, a sampling rate of 1.7 MHz would be necessary for this purpose. The computation complexity for this would be enormous. Using the method according to the invention, it is possible to manage with a far smaller number of samples. In this case, sampling rates of about 10 kHz are adequate.

In order to assess the gradient value which will be used for evaluation, a maximum value of the gradient is preferably determined, a decay function is produced on the basis of this maximum value, and only those zero crossings whose gradient magnitude exceeds the value of the decay function at this point in time are subjected to further processing. On the one hand, the decay function filters out all the zero crossings whose gradient is too small. In addition, no computation power is required for these zero crossings during the further processing. The exclusion of zero crossings which are not significant thus occurs relatively early. In addition, in contrast to a fixed threshold value, the decay function has the advantage that account is taken of the dynamic range of a real musical instrument. The gradient is also governed, inter alia, by the volume with which the instrument is played. Furthermore "spikes" can occur in the gradient at the moment when a string is struck, which spikes are in principle not significant. The decay function ensures that, despite matching to the dynamic range of the instrument, exclusion of those zero crossings which have an excessively low gradient is possible, but on the other hand also ensures that the spikes mentioned above do not block the method in the long term.

It is in this case particularly preferred for the values of the decay function to be reduced only when a zero crossing occurs. This saves computation power, but on the other hand also ensures that the decay function is reduced step by step.

It is also preferred for the values of the decay function to be multiplied by a constant factor on every reduction. This results in an exponential decay behavior being achieved, which initially leads to a relatively drastic reduction and later to a moderate reduction. Spikes are therefore eliminated more quickly.

The remaining gradient values are preferably subjected at least a second time, in the same way, to the comparison with a decaying function. An improved evaluation capability is obtained in this way. As a result of the natural non-uniform nature of an audio signal, in particular in the region of its start when produced by striking, it is possible for a relatively large scatter to occur in the gradient values. If the threshold value is too high, significant zero crossings are not recognized although they should be recognized. If the signal has a large number of zero crossings, the decay function quickly decays to an excessively small value, so that a zero crossing is incorrectly classified as significant as result of a comparison of the gradient with the decay function. The second (or further) "filtering" on the one hand excludes those values which are still incorrect or unnecessary, but on the other hand reliably retains all the significant values. As a rule, one second comparison is sufficient in order actually to determine the steepest zero crossings, which are used for the determination of the period length.

The gradient at the zero crossing is preferably interpolated from a plurality of gradient values of the audio signal in the vicinity of the zero crossing. While one gradient determination from two values is sufficient when the basis is an essentially linear signal waveform in the region of the zero crossing, errors result in the case of this simple gradient determination if the signal waveform in this region has a relatively high degree of curvature. In this case, improved accuracy can be achieved by using further samples from the vicinity of the zero crossing.

A zero crossing is advantageously rejected as being insignificant if its gradient does not achieve a predetermined proportion of the magnitude of the gradient of a subsequent zero crossing. In this way, spikes, that is to say values which do not fit the normal signal waveform, can also be eliminated easily and quickly.

The point in time of a significant zero crossing is preferably determined by interpolation. However, such an interpolation is necessary only when a significant zero crossing has actually been found. Computation power is thus required only when a useful result can actually be expected.

Successive time intervals between zero crossings are advantageously compared with one another, and a pitch is determined only in the event of discrepancies below a predetermined limit. This is advantageous in particular if the pitches and the associated period lengths are stored in a table. As long as the period length does not change, the pitch also does not change. It is thus unnecessary to start a new computation or search operation in order to determine information, since the information is already present. This also saves considerable computation time.

In a particularly preferred refinement, a fixed sampling frequency is used for the audio signal and an initial value for the pitch is produced only at the end of time interval having a predetermined constant length, by averaging over the determined pitch values in the time interval. Such a time interval can have, for example, a length of 8 to 15 ms. A fixed sampling frequency leads to more samples per period in the case of deeper tones and to fewer samples per period in the case of higher tones. The relative accuracy for pitch determination in the case of higher tones would thus accordingly and intrinsically be reduced. This disadvantage is compensated for by the averaging in the fixed time interval. The relative accuracy in the case of one individual period is admittedly somewhat lower. However, the fact that a greater number of periods are accommodated in a fixed time interval in the case of higher tones results in the averaging once again giving a better approximation to the actual pitch.

It is in this case particularly advantageous for the initial value to be passed on via an interface only when it differs by more than a predetermined amount from the last initial value passed on. Such an interface can be, for example, a "musical instrument digital interface" (MIDI). Such an interface is also still in widespread use for other forms of signal transmission. By limiting the transmitted data to changes, the interface is kept free.

The audio signal is preferably low-pass-filtered before the pitch recognition. Such low-pass filtering should be carried out very cautiously, for example using a two-pole IIR filter, in order to avoid filtering out too much information. As a guidance figure, one can assume that not more than ten zero crossings should be present per period after filtering.

Zero crossings are advantageously evaluated both in the positive direction and in the negative direction. Admittedly, more computation power is required for this than in the case of the limitation to one polarity. On the other hand, additional information is obtained, which contributes to an improvement in the accuracy.

It is particularly preferred in this case for a zero crossing not to be evaluated if its gradient is less than half the gradient of the preceding zero crossing of opposite polarity. In this case, use of this zero crossing to determine the period length is dispensed with. However, since, on the other hand, the period length is available via the interval between the zero crossings of the other polarity, this information loss can be coped with.

BRIEF DESCRIPTION OF THE DRAWINGS

The invention is described in the following text with reference to a preferred exemplary embodiment in conjunction with the drawing, in which.

DESCRIPTION OF PREFERRED EMBODIMENTS

Figure 1:
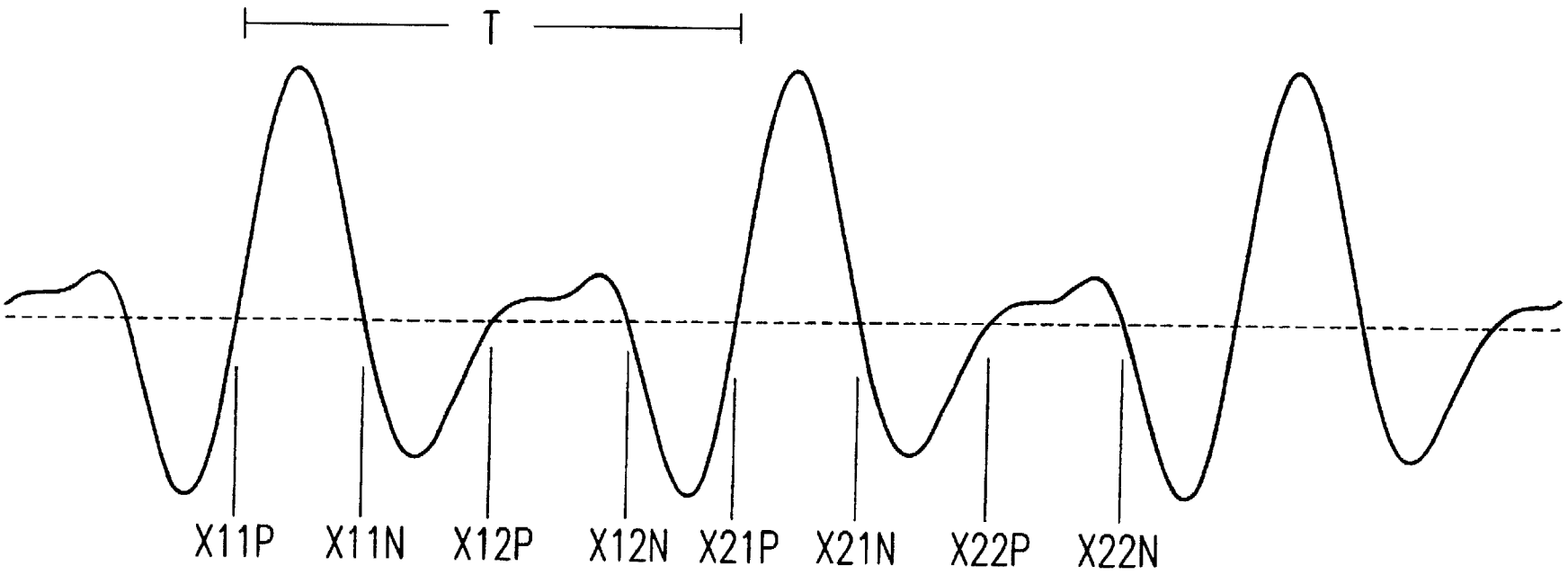
FIG. 1 shows a typical audio signal waveform with zero crossings.
Figure 3:
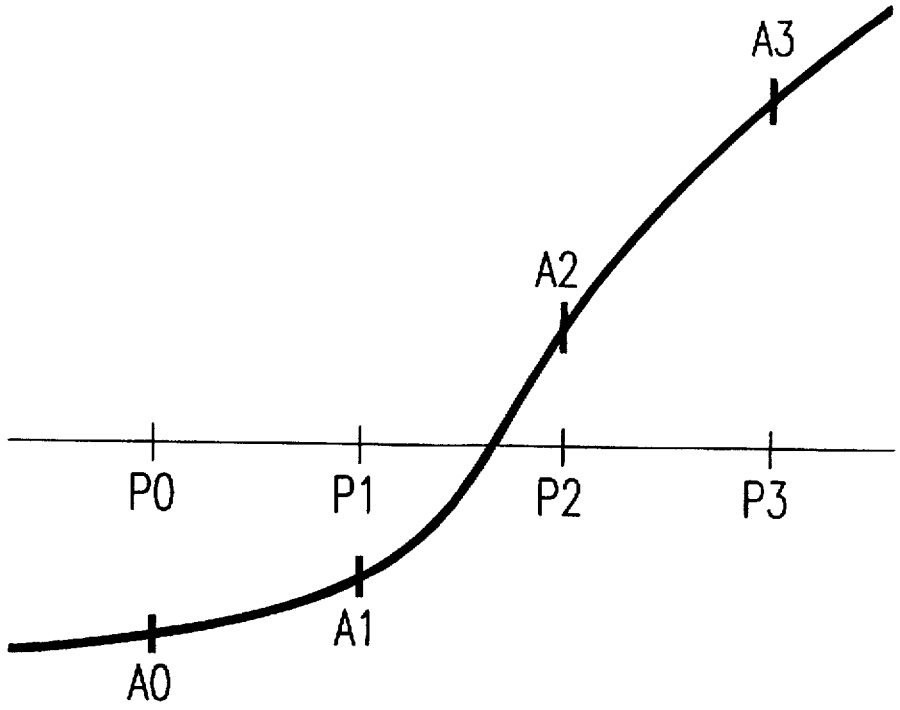
FIG. 3 shows a detail from a signal waveform in the vicinity of a zero point.

FIG. 1 shows the waveform of a typical audio signal in which a plurality of zero crossings are present in each period T. The illustrated signal has already passed through low-pass filtering, a simple, two-pole IIR filter having been used. This filter removes disturbing harmonics. Such a signal is digitalized for further processing, that is to say amplitude values A0, A1, A2, A3 . . . are determined at various points in time P0, P1, P2, P3, . . . (FIG. 3) and are converted into a digital value. The values can be stored in a shift register or FIFO buffer in order to keep a stock of more than two values.

The zero crossings of the signal waveform illustrated in FIG. 1 can easily be determined by comparing two successive samples with one another. If both have the same polarity, for example in the case of the value pairs A0, A1 and A2, A3, then there is no zero crossing between them. Such values can be left out if one ignores exceptions in the immediate vicinity of such a zero crossing. The period length P results from the interval between two such zero crossings, that is to say X21P—X11P or X22P—X12P or X21N—X11N or X22N—X12N. Although all the options for period length determination are possible, the most accurate result is obtained if the value pairs X21P, X11P or X21N, X11N are used because the signal waveform has the greatest gradient at the zero crossing at these points. A disturbance has the least effect here, that is to say the offset of the zero crossing becomes smaller, the steeper the signal waveform is at the zero crossing.

A relatively simple method is used for determination of the steepest zero crossings, and is explained in the following text with reference to FIG. 2.

Figure 2A:
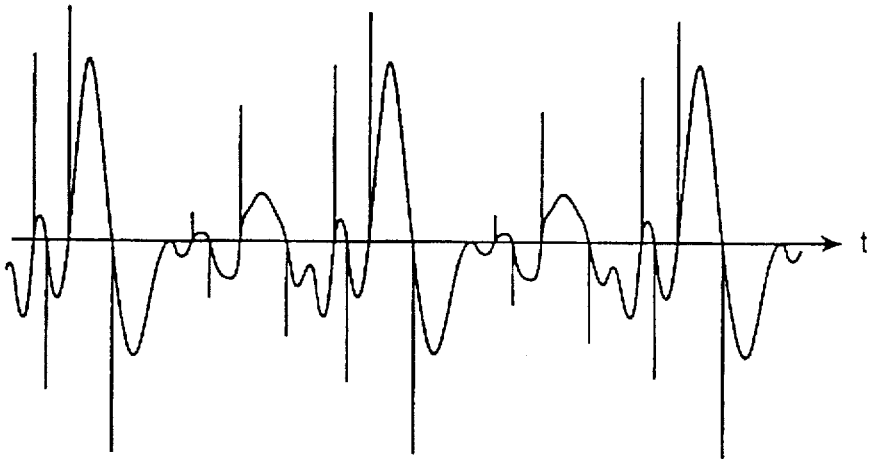
FIG. 2 shows a schematic illustration of method steps for pitch recognition.
Figure 2B:
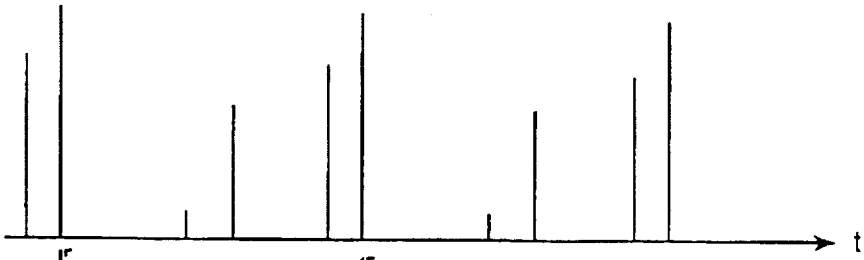

FIG. 2*a* shows a typical signal waveform having a plurality of zero crossings per period. The magnitude of the gradient of the signal waveform at each zero crossing is also shown. FIG. 2*b* shows the positive gradient values. The gradient values were in this case simply determined by subtraction between the two samples in each case adjacent to the respective zero crossing. Since the sampling rate in the present case is constant at 10 kHz, the difference is sufficient to be able to make a statement about the gradient.

It is possible to see just by comparison between FIGS. 2*a* and 2*b* that a large amount of information is no longer required for further evaluation. Thus, no computation power is any longer required for this amount of information either.

Figure 2C:
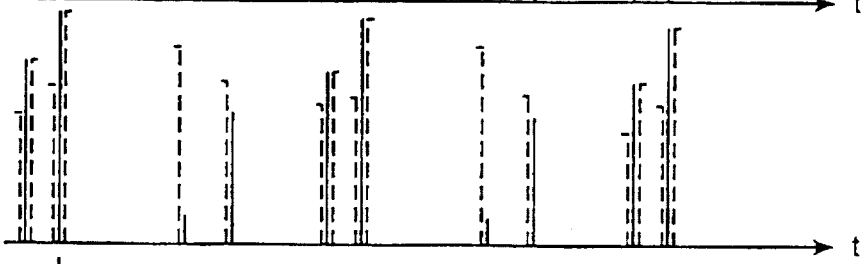

FIG. 2*c* shows the gradient values from FIG. 2*b*. In addition, the values of a decay function are illustrated by dashed lines, this decay function being formed as follows:

Let D be the value of the gradient, ENV1 the value of the decay function and F1 a constant decay factor, for example 11/16.

At the first zero crossing, ENV1 is set to the value D.

At the next zero crossing, the decay function is changed:

$$ENV1=F1\times ENV1$$

If, now:

$$D>ENV1$$

then $$ENV1=D$$

is set.

This case is shown for the second zero crossing. If D<ENV1, then this is a zero crossing having a small gradient, which can be regarded to be non-significant. This point is removed from the further evaluation.

Figure 2D:
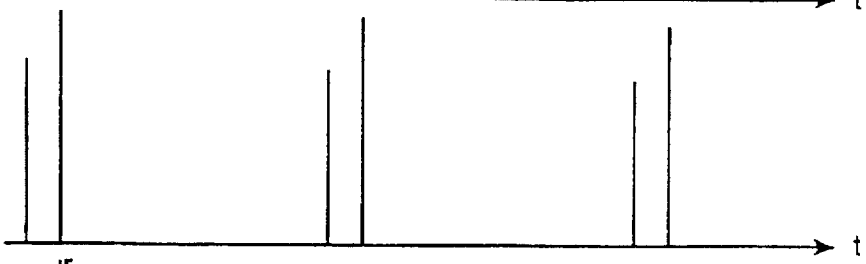
Figure 2E:
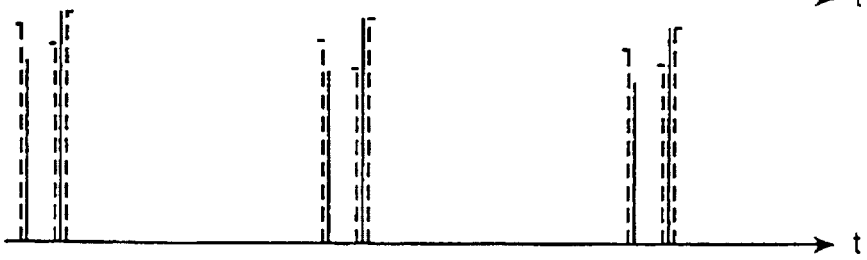

As can be seen from FIG. 2*d*, only the first, second, fifth, sixth, ninth, tenth etc. zero crossings still remain after this first filtering. All the other zero crossings have already been eliminated.

In the same manner, the remaining zero crossings can be subjected to further filtering (FIG. 2*e*), ENV2 being the values of the second decay function and F2 the decay factor:

$$ENV2=F2\times ENV2$$

This zero crossing is evaluated further only if D>ENV2. If this is not the case, the corresponding zero crossing is rejected as not being significant.

Figure 2F:
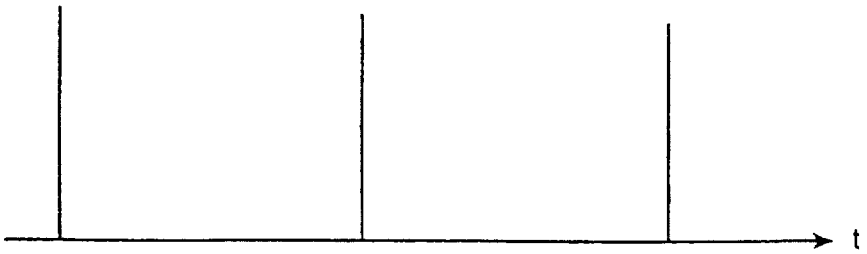

It can be seen in FIG. 2*f* that only the steepest zero crossings are left after this filtering. The interval between these zero crossings is the period length T which, in turn, is a measure of the pitch.

In order to improve the accuracy, further points can be used in the vicinity of the zero crossing, for example no longer just the two adjacent points P1, P2 but also the points P0 and P3 before them and after them.

If the following notation is used:

$$D10=A1-A0$$

$$D21=A2-A1$$

$$D32=A3-A2$$

$$dx=A2/(A2-A1)$$ (Distance between the zero crossing and the point P2)

then the gradient D becomes:

$$D=(D21+dx\times D10+(1-dx)\times D32)/2$$

If one wishes to avoid a floating point operation, such an interpolation can also be carried out using an integer operation if 16-times "oversampling" is simulated. The division by two can also be avoided if one is not interested in the absolute gradient but only in the ratio between the individual gradient values. In this case, one can set:

$$dx=(A2<<4)/(A2-A1)$$

$$D=(dx\times(A2-A0)+(16-dx)\times(A3-A1)$$

The symbol "<<" in this case means a "shift left" operation in the binary domain. The illustrated shift by four bits to the left thus results in multiplication by 16. In this case, the point in time of the zero crossing becomes $$T=(IX<<4)\times dx,$$

where IX is the sampling index of the point P2. The difference between two successive zero crossing points in time determined in this way then produces the period length.

If the difference between two successive period lengths is now less then a predetermined value, for example 40 to 60 cents, then it can be assumed that the determined period length actually corresponds to the period length of the oscillation. In this case, the period length is formed by the arithmetic mean of the two successive period lengths, in order to eliminate small inaccuracies as well.

A further error correction possibility is created by also comparing successive values with one another backwards. For example, a sequence of gradient values 50, 35, 27 is sensible. This corresponds to a rapidly decaying signal. In contrast, a sequence of 50, 35, 48 is relatively improbable. In this case, the second value (35) would not fit in with the signal. The associated zero crossing should thus be removed. This can be implemented relatively easily by comparing the preceding value with a predetermined proportion of the current value. If F3 is a constant value <1, for example ¾, the zero crossing associated with the gradient D (n−1) is eliminated if $$F3 \times D(n) > D(n-1)$$

The absolute accuracy of the described method is $\pm 1/32$ T, where T is the sampling period. The relative accuracy is governed by the frequency. It is greater for low frequencies and is thus sufficient to produce a signal with the initially mentioned inaccuracy of 1 cent (1/100th half tone). However, the relative error increases at higher frequencies, so that there is a risk here of incorrect pitch information being produced. This error is overcome by no longer producing a pitch signal at the end of each period, but at the end of a predetermined "time slot" with a constant length of, for example, 8 to 15 ms. Faster provision of the pitch information is unnecessary anyway, because the subsequent processing takes a corresponding period of time. Fewer periods are obtained at low frequencies in such a time slot, but they have been determined with high relative accuracy, or a large number of periods are obtained in the case of high pitches, which have been determined with lower relative accuracy. If the period lengths in the respective time slot are now averaged, the inaccuracies can be overcome again to such an extent that they are no longer found to be unpleasant by the human ear.

The period length and thus the pitch information are obtained both from zero crossings with a positive gradient and from zero crossings with a negative gradient. The situation occasionally arises where the magnitudes of these gradients differ very greatly from one another. If one amount is more than twice as great as the other, the zero crossing having the smaller gradient is not considered.

It is also possible to define a minimum gradient which must be present in order that a zero crossing is intended to be evaluated at all during the pitch determination. This minimum gradient can also be changed dynamically by using half the maximum gradient of the preceding time slot as the minimum gradient for the next time slot.

Figure 4:
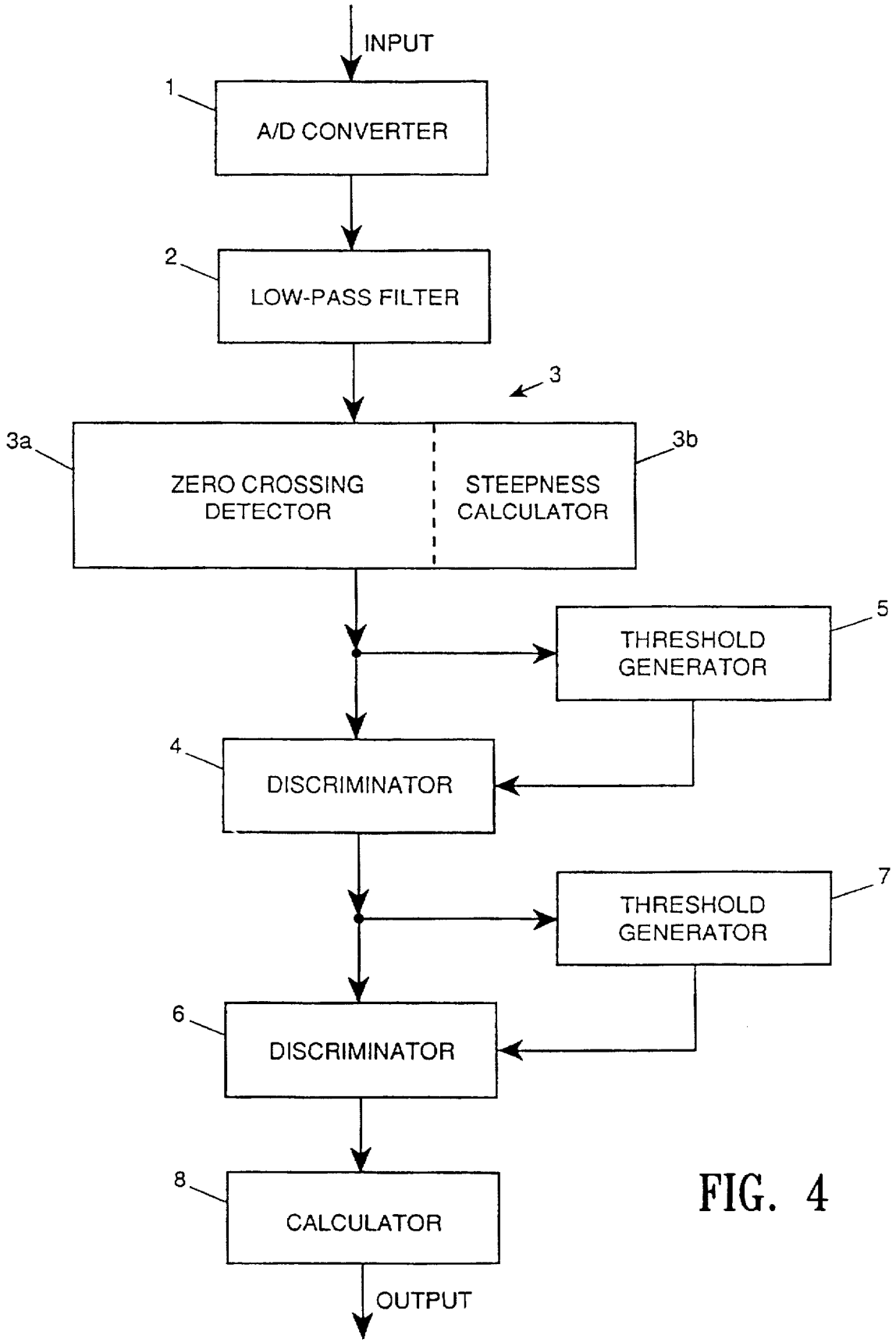
FIG. 4 shows a block diagram of a tone pitch recognition apparatus according to the invention.

FIG. 4 shows a schematic diagram of a tone pitch recognition apparatus according to the invention. A waveform signal received from the pickup of a string instrument, such as a guitar, is fed as an audio input signal to A/D-converter 1, where it is sampled at a constant sampling rate and converted into a digital signal. The digital output signal is filtered in low-pass filter 2 in order to remove disturbing harmonics. The output of low-pass filter 2, which may be represented by waveform as shown in FIG. 2A, is then input to a computation unit 3 consisting of a zero crossing detector 3*a* and a steepness calculator 3*b* where it is subject to zero crossing detection in zero crossing detector 3*a*. The zero crossing detector determines the timings of the zero crossings according to one of the methods described above. The steepness calculator 3*b* calculates for each zero crossing a steepness value indicating the steepness of the waveform in each zero crossing. Several methods of how to calculate the steepness have been disclosed above. The most simple way to calculate the steepness is to calculate the absolute value of the difference of two sampling values in the immediate neighbourhood of a respective zero crossing.

The zero crossing detector 3*a* and the steepness calculator 3*b* reduce the amount of data received from low-pass filter 2 drastically. The output of the computation unit 3 consists of a sequence of pairs of data, the first data of each pair indicating the timing position of the zero crossing, the second data of each pair indicating the steepness of the waveform in the point of the respective zero crossing.

In order to eliminate those zero crossings having a relatively low steepness the output of the computation unit 3 is subject to discriminator 4. This discriminator 4 eliminates all those zero crossings whose steepness is below a certain threshold. The threshold ENV1 is generated by generator 5 according to the method described above. Shortly stated the threshold ENV1 is reduced by a constant factor F1 at each zero crossing and it is raised to assume the steepness value of the zero crossing, provided that the steepness value is higher than the previous threshold.

Thus the discriminator 4 eliminates all zero crossings having a relatively low steepness so that the amount of data is reduced to the data as exemplified in FIG. 2D. A second filtering of this kind by discriminator 6 and generator 7 finally leads to a set of data as exemplified by FIG. 2F. The remaining zero crossings at the output of discriminator 6, which are shown in FIG. 2F correspond to the basic zero crossings which define the period length of the musical tone. The calculator 8 determines the time interval between at least two of the remaining zero crossings and calculates its inverse value, which corresponds directly to the basic frequency of the musical tone, whose waveform is to be analyzed. The frequency signal can be easily converted into a tone pitch signal which is output by calculator 8.

Having thus described the principles of the invention together with several illustrative embodiments thereof, it is to be understood that although specific terms are employed, they are used in a generic and descriptive sense, and not for purposes of limitation, the scope of the invention being set forth in the following claims:

We claim:

1. A method for automatic pitch recognition, in particular for musical instruments which are excited by plucking or striking, the method comprising determining the distance between zero crossings of a signal waveform of an audio signal and using the distance between zero crossings as a measure for the period length of the audio signal, wherein the magnitude of the gradient of the signal waveform is in each case determined in the region of its zero crossings, and wherein the magnitude of the gradient is used as an assessment criterion for the selection of the zero crossings to be evaluated.

2. The method as claimed in claim 1, wherein a maximum value of the gradient is determined, a decay function is produced on the basis of this maximum value and only those zero crossings whose gradient magnitude exceeds the value of the decay function at this point in time are subjected to further processing.

3. The method as claimed in claim 2, wherein the values of the decay function are reduced only when a zero crossing occurs.

4. The method as claimed in claim 3, wherein the values of the decay function are multiplied by a constant factor whenever they are reduced.

5. The method as claimed in claim 2, wherein the remaining gradient values are subjected in the same way at least a second time to the comparison with a decaying function.

6. The method as claimed in claim 1, wherein the gradient at the zero crossing is interpolated from a plurality of gradient values of the audio signal in the vicinity of the zero crossing.

7. The method as claimed in claim 1, wherein a zero crossing is rejected as insignificant if its gradient does not reach a predetermined proportion of the magnitude of the gradient of a subsequent zero crossing.

8. The method as claimed in claim 1, wherein the gradient of the signal waveform is determined at a plurality of discrete sample points and wherein the point in time of a significant zero crossing is determined by interpolation using plural sample points.

9. The method as claimed in claim 1, wherein successive time intervals between zero crossings are compared with one another, and a pitch is determined only in the event of discrepancies which are less than a predetermined limit.

10. The method as claimed in claim 1, wherein a fixed sampling frequency is used for the audio signal, and an original value of the pitch is produced only at the end of time intervals having a predetermined constant length, by averaging of the determined pitch values in the time interval.

11. The method as claimed in claim 10, wherein the initial value is passed on via an interface only when it differs by more than a predetermined amount from the last initial value passed on.

12. The method as claimed in claim 1, wherein the audio signal is low-pass-filtered before the pitch recognition.

13. The method as claimed in claims 1, wherein the zero crossings are evaluated both in the positive direction and in the negative direction.

14. The method as claimed in claim 13, wherein a zero crossing is not evaluated if its gradient is less than half the gradient of the preceding zero crossing of the opposite polarity.

15. A tone pitch recognition apparatus for determining the tone pitch of a musical tone represented by a waveform consisting of amplitude values A (t) as a function of time, said waveform consisting of several periods of substantially equal length defining said tone pitch, each period of said waveform comprising several zero crossings at which A(t)=0, said tone pitch recognition apparatus comprising:

(a) zero crossing detection means for detecting said zero crossings of said waveform in at least one period of said waveform;

(b) steepness calculating means for determining a steepness value of said waveform for each of said zero crossings;

(c) threshold generating means for generating a threshold;

(d) discriminating means in which said steepness value is compared with said threshold for discriminating those of said detected zero crossings whose steepness value is below said threshold and thus determining remaining zero crossings for said at least one period;

(e) calculating means for calculating said tone pitch based on said remaining zero crossings defining the length of said at least one period.

16. The tone pitch recognition apparatus according to claim 15, wherein said generating means generates a dynamic threshold which is modified at each time a zero crossing occurs.

17. The tone pitch recognition apparatus according to claim 16, wherein said dynamic threshold is modified in such a way that it is increased after each occurrence of a zero crossing having a steepness value exceeding said threshold and it is decreased each time before comparing it to the steepness value of a subsequent zero crossing.

* * * * *